US006902376B2

(12) United States Patent
Gautreau et al.

(10) Patent No.: US 6,902,376 B2
(45) Date of Patent: Jun. 7, 2005

(54) COMPRESSOR BLADE WITH DOVETAIL SLOTTED TO REDUCE STRESS ON THE AIRFOIL LEADING EDGE

(75) Inventors: James Charles Gautreau, Greenville, SC (US); Nicholas Francis Martin, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/327,949

(22) Filed: Dec. 26, 2002

(65) Prior Publication Data

US 2004/0126239 A1 Jul. 1, 2004

(51) Int. Cl.[7] ..... F01D 5/30

(52) U.S. Cl. ..... 416/219 R; 416/248; 416/224; 416/500

(58) Field of Search ..... 416/225, 500, 416/248, 219 R, 220 R, 221, 204 A, 223 A, 224, 244 A

(56) References Cited

U.S. PATENT DOCUMENTS

| | | | | |
|---|---|---|---|---|
| 2,913,221 A | * | 11/1959 | Klint et al. | 416/500 |
| 2,994,507 A | | 8/1961 | Keller et al. | |
| 4,221,542 A | | 9/1980 | Acres et al. | |
| 4,480,957 A | | 11/1984 | Patel et al. | |
| 4,682,935 A | | 7/1987 | Martin | |
| 4,872,810 A | | 10/1989 | Brown et al. | |
| 5,123,813 A | | 6/1992 | Przytulski et al. | |
| 5,256,035 A | | 10/1993 | Norris et al. | |
| 5,277,548 A | | 1/1994 | Klein et al. | |
| 5,536,143 A | | 7/1996 | Jacala et al. | |
| 5,573,377 A | | 11/1996 | Bond et al. | |
| 5,582,077 A | | 12/1996 | Agram et al. | |
| 5,924,843 A | | 7/1999 | Staub et al. | |
| 6,033,185 A | | 3/2000 | Lammas et al. | |
| 6,065,938 A | * | 5/2000 | Bartsch | 416/248 |
| 6,095,750 A | | 8/2000 | Ross et al. | |
| 6,132,174 A | | 10/2000 | Staub et al. | |
| 6,190,131 B1 | | 2/2001 | Deallenbach | |
| 6,402,471 B1 | | 6/2002 | Demers et al. | |
| 6,419,753 B1 | | 7/2002 | Wheat et al. | |
| 6,457,942 B1 | | 10/2002 | Forrester | |
| 6,478,537 B2 | * | 11/2002 | Junkin | 416/224 |
| 6,752,594 B2 | * | 6/2004 | Miller et al. | 416/500 |
| 6,769,877 B2 | * | 8/2004 | Martin et al. | 416/219 R |
| 2002/0081205 A1 | * | 6/2002 | Wong | 416/248 |

FOREIGN PATENT DOCUMENTS

| | | | | |
|---|---|---|---|---|
| CH | 660207 A5 | * | 3/1987 | F01D/5/26 |
| GB | 906476 | | 9/1962 | |
| JP | 51127302 A | | 11/1976 | |
| JP | 57076208 A | * | 5/1982 | F01D/5/22 |
| JP | 57186004 A | | 11/1998 | |

OTHER PUBLICATIONS

UK Patent Office Search Report for GB04088670.0.

* cited by examiner

*Primary Examiner*—Edward K. Look
*Assistant Examiner*—Richard A. Edgar
(74) *Attorney, Agent, or Firm*—Nixon & Vanderhye, P.C.

(57) ABSTRACT

A blade of an axial compressor comprising: an airfoil is disclosed that has a leading edge and a root; a platform attached to the root of the airfoil; a dovetail attached to a side of the platform opposite to the airfoil; a neck of the dovetail adjacent the platform, and a slot in the neck and generally parallel to the platform, and the slot extends from a front of the neck to position in the neck beyond a line formed by the leading edge of the blade.

20 Claims, 3 Drawing Sheets

COMPRESSOR BLADE WITH DOVETAIL SLOTTED TO REDUCE STRESS ON THE AIRFOIL LEADING EDGE

BACKGROUND OF THE INVENTION

The invention relates to compressor blades and, in particular, to leading edge treatments to increase blade tolerance to erosion.

Water is sprayed in a compressor to wash the blades and improve performance of the compressor. Water washes are used to clean the compressor flow path especially in large industrial gas turbines, such as those used by utilities to generate electricity. Water is sprayed directly into the inlet to the compressor uniformly across the flow path.

Water sprayed on the hub hits the blades of the first stage of the compressor. These rotating first stage blades shower water radially outward into the flow path of the compressor. The water is carried by the compressor air through the compressor vanes and blades. The water cleans the compressor and vane surfaces. However, the impact of the water on the first stage blades tends to erode the leading edge of those blades especially at their roots, which is where the blade airfoil attaches to the blade platform.

Erosion can pit, crevice or otherwise deform the leading edge surface of the blade. Erosion often starts with an incubation period during which the blade, e.g., a new blade, is pitted and crevices form in the blade leading edge. As erosion continues, the population of pits and crevices increases and they deepen into the blade.

The blade is under tremendous stress due to centrifugal forces and vibration due to the airflow and the compressor machine. These stresses tear at the pit and crevices and lead to a high cycle fatigue (HCF) crack in the blade. Once a crack develops, the high steady state stresses due to the centrifugal forces that act on a blade and the normal vibratory stresses on the blade can cause the crack to propagate through the blade and eventually cause the blade to fail. A cracked blade can fail catastrophically by breaking into pieces that flow downstream through the compressor and cause extensive damage to other blades and the rotor. Accordingly, there is a long felt need to reduce the potential of cracks forming in compressor blades due to blade erosion.

BRIEF DESCRIPTION OF THE INVENTION

In one embodiment, the invention is a blade of an axial compressor comprising: an airfoil having a leading edge and a root; a platform attached to the root of the airfoil; a dovetail attached to a side of the platform opposite to the airfoil; a neck of the dovetail adjacent the platform, and a slot in the neck and generally parallel to the platform, where said slot extends from a front of the neck to a position in the neck beyond a line formed by the leading edge of the blade. Further, the slot may extend a width of the neck, and is a key-hole shaped slot.

The slot may have a narrow gap extending from the front of the neck and extending to a cylindrical aperture portion of the slot. The cylindrical aperture has an axis that is offset from said slot narrow gap. In addition, an insert shaped to fit snugly in said slot may be inserted into the slot during installation of the compressor blade. The insert may have a narrow rectangular section attached to a cylindrical section, where the insert fits in the slot.

In a second embodiment, the invention is a method for unloading centrifugal stresses from a leading edge of an airfoil of a compressor blade having a platform and a dovetail, the method comprising: generating a slot in the dovetail below a front portion of the platform, wherein the slot underlies the leading edge of the airfoil; forming a cylindrical aperture at an end of the slot, wherein said cylindrical aperture is generally parallel to the platform and extends through the dovetail, and by generating the slot with the cylindrical, reducing centrifugal and vibratory load on at least the root of the leading. The blade may be a first stage compressor blade.

In this method, the slot extends the width of the neck and is generated as a key-hole shaped slot. Further, the slot is generated by cutting a narrow gap into a front of the neck and said cylindrical aperture formed at a rear of the narrow gap by drilling through the neck. Alternatively, the slot is generated while casting the dovetail. An insert may be slid into the slot, where the insert substantially fills the slot.

In a third embodiment, the invention is a blade of an axial compressor comprising: an airfoil having a leading edge and a root; a platform attached to the root of the airfoil; a dovetail attached to a side of the platform opposite to the airfoil, and a neck of the dovetail adjacent the platform, wherein a corner of the neck aligned with the leading edge of the blade is not attached to a portion of the platform opposite to the leading edge of the blade. The corner region of the neck portion may be a conical quarter section with a rounded surface and the corner region is joined to the platform via a fillet.

DETAILED DESCRIPTION OF THE INVENTION

To increase blade tolerance to erosion, the geometry of the first stage compressor blade has been modified to reduce the stresses acting on the leading edge of a blade. The tremendous centrifugal and vibratory stresses that act on a blade can cause small pits and surface roughness to initiate a crack leading to blade failure.

Figure 1:
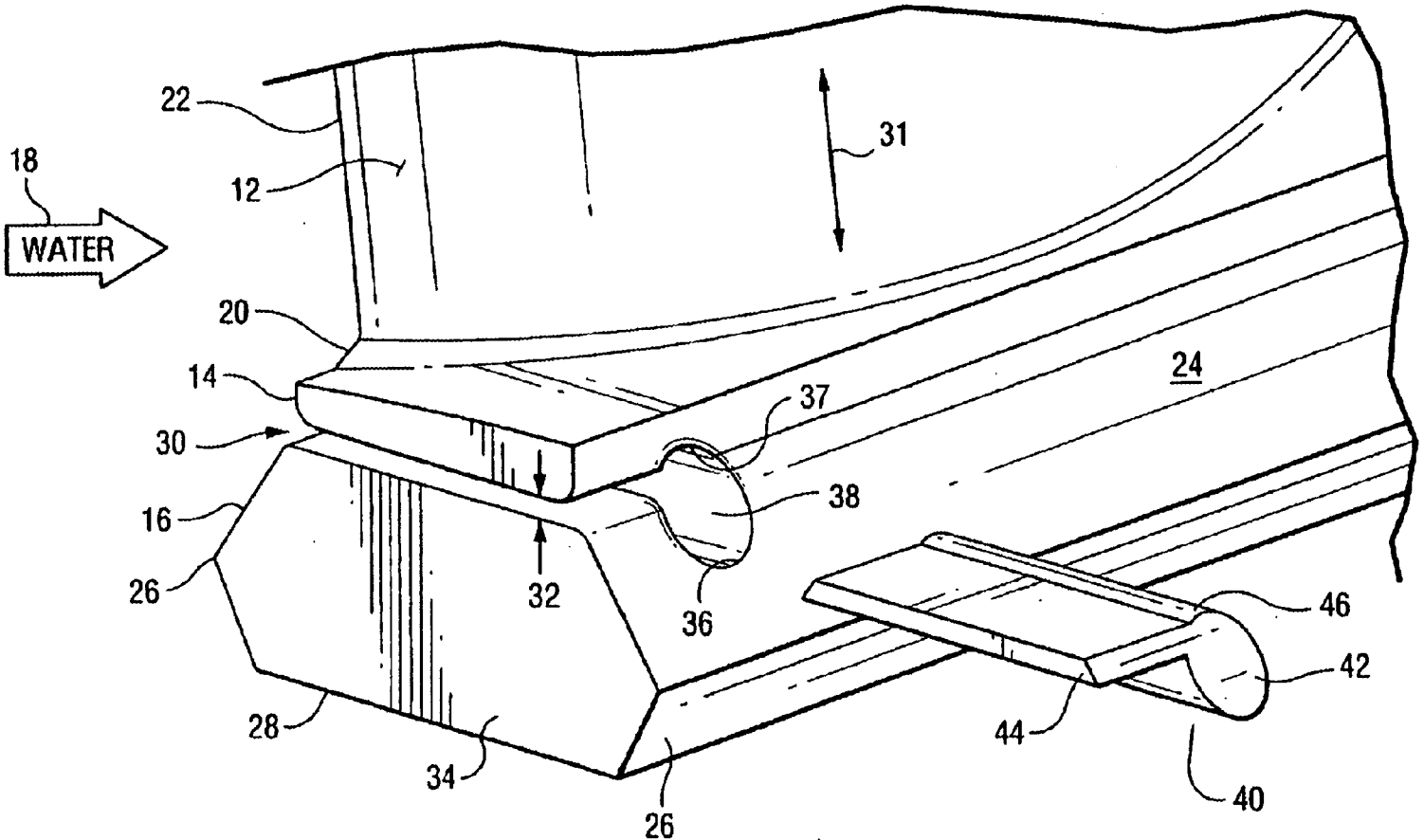
FIG. 1 is an enlarged perspective view of portion of a compressor blade having a slot in its dovetail connector, and an insert for the slot.
Figure 2:
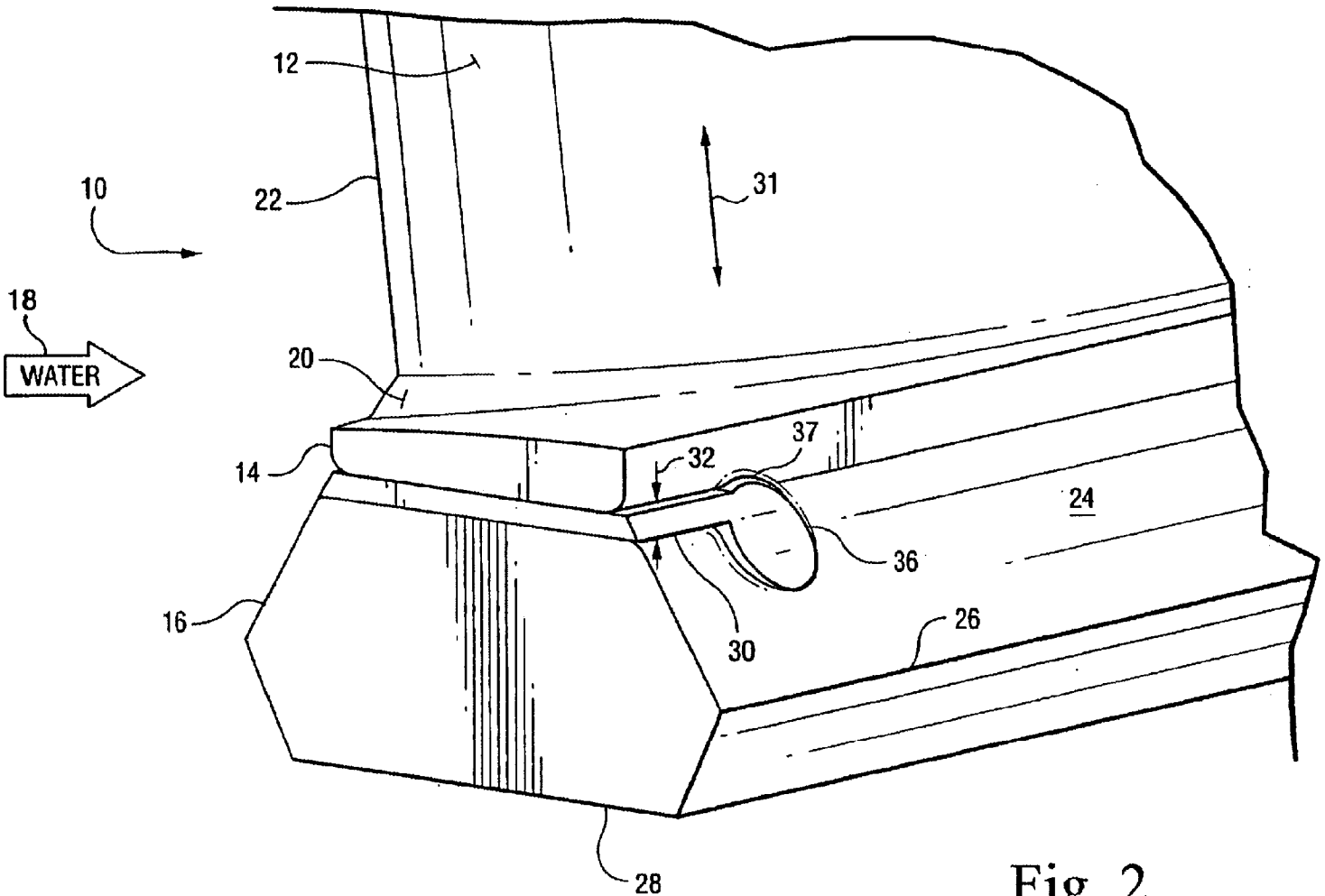
FIG. 2 is an enlarged perspective view of the base of a compressor blade shown in FIG. 1 with the insert in the slot.

FIGS. 1 and 2 show a portion of a first stage blade 10 of a multistage axial compressor of an industrial gas turbine engine, such as used for electrical power generation. The compressor blade includes a blade airfoil 12, a platform 14 at the root 20 of the blade, and a dovetail 16 that is used to connect the blade to a compressor disk (not shown). The dovetail 16 attaches the blade to the rim of the disk. An array of compressor blades are arranged around the perimeter of the disk to form an annular row of blades.

During an on-line water wash, water 18 is uniformly sprayed into the compressor. Large water droplets tend to hit a lower portion of the airfoil surface 12 of the blade, which is near the root 20 of the blade.

Air flows over the airfoil surface 12 of the row of compressor blades in each stage of the compressor. The shape and surface roughness of the airfoil surface are important to the aerodynamic performance of the blades and the compressor. Large water droplets hitting the leading edge 22 of the first stage blades can erode, pit and roughen the airfoil surface 12.

The platform 14 of the blade is integrally joined to the root 20 of the airfoil 12. The platform defines the radially inner boundary of the air flow path across the blade surface from which extends the blade airfoil 12. An opposite side of the platform is attached to the dovetail connector 16 for the blade.

The dovetail 16 fits loosely in the compressor disk until the rotor spins and then centrifugal forces push the dovetail firmly radially upward against a slot in the disk. The force of the disk on the dovetail connector counteracts the centrifugal forces acting on the rotating blade. These opposite forces create stresses in the blade airfoil 12. The stresses are concentrated in the blade at certain locations, such as where the root 20 of the blade is attached to the platform 14.

The dovetail 16 has a neck region 24 just below the platform, a wide section 26 with lobes that engage a slot in the disk perimeter, and a bottom 28. A slot 30 extends through the neck below the platform. The slot is perpendicular to the axis 32 of the blade and is generally parallel to the platform. The slot 30 is cut into the dovetail neck 24 below the platform and beneath the leading edge 22 of the blade airfoil 12. The slot extends the width of the neck of the dovetail. The slot has a generally key-hole shape with a narrow gap 32 starting at the front of the dovetail and extending underneath the leading edge of the airfoil blade. The end of the slot expands into a generally cylindrical section 36 having a generous radius to reduce stresses caused by the slot on the dovetail. The cylindrical section 36 intersects with the narrow gap 31 of the slot such that the axis 38 of the cylinder is slightly below the centerline of the gap 32. The upper surface of the slot and cylinder (which is the lower surface of the front portion of the platform) is generally flat except for a slight recess 37 corresponding an upper ridge 46 of a cylinder insert 40. The slot may be formed by machining, such as by cutting the narrow gap 32 and by drilling out the cylindrical aperture 36. Alternatively, the slot 30 may be formed with the casting of the dovetail.

The slot 30 in the dovetail reduces the stress applied to the leading edge 22 of the airfoil, especially at the root 20 where the airfoil attaches to the platform 14. Stress reduction occurs because the front of the platform is disconnected from the dovetail directly. The front of the platform extends as a cantilever beam over the dovetail. Because the front of the platform is not directly attached to the underlying dovetail, the stress is reduced due to centrifugal forces that would otherwise pass from the dovetail, through the front of the platform and to the leading edge of the airfoil. Due to the reduction of stress on the leading edge 22 of the root 20 of the blade airfoil, the likelihood is reduced that erosion induced pits and other surface defects will propagate into cracks. Accordingly, the slot 30 through the dovetail should significantly reduce the risk of HCF cracks emanating from erosion damage at the lower section of the leading edge of a blade.

An insert 40 is fitted into the slot 30. The insert is show in FIG. 1 as separated from the slot and in FIG. 2 is shown as inserted into the slot. The insert has a shape similar to that of the slot. The insert is a non-metallic component that fits snugly into the slot. The insert reduces the potential of acoustic resonance in the cavity of the slot. The insert also prevents dirt, water and other debris from accumulating in the slot. The insert does not transmit centrifugal stresses from the dovetail to the leading edge of the blade via the platform. The insert has a cylinder portion 42 that fits into the cylinder aperture 36 of the slot. The insert has a rectangular portion 44 that extends from the cylinder and fits in the narrow section 33 of the slot 30. The upper ridge 46 of the cylinder 42 may protrude slightly up from the rectangular portion 44 of the insert.

In an alternative embodiment, the cut-away section is a block extends across the entire front of the dovetail. This alternative embodiment is the subject of another application, which is U.S. patent application Ser. No. 10/065,453 that is commonly-owned with the present application and shares at least one common inventor.

Figure 3:
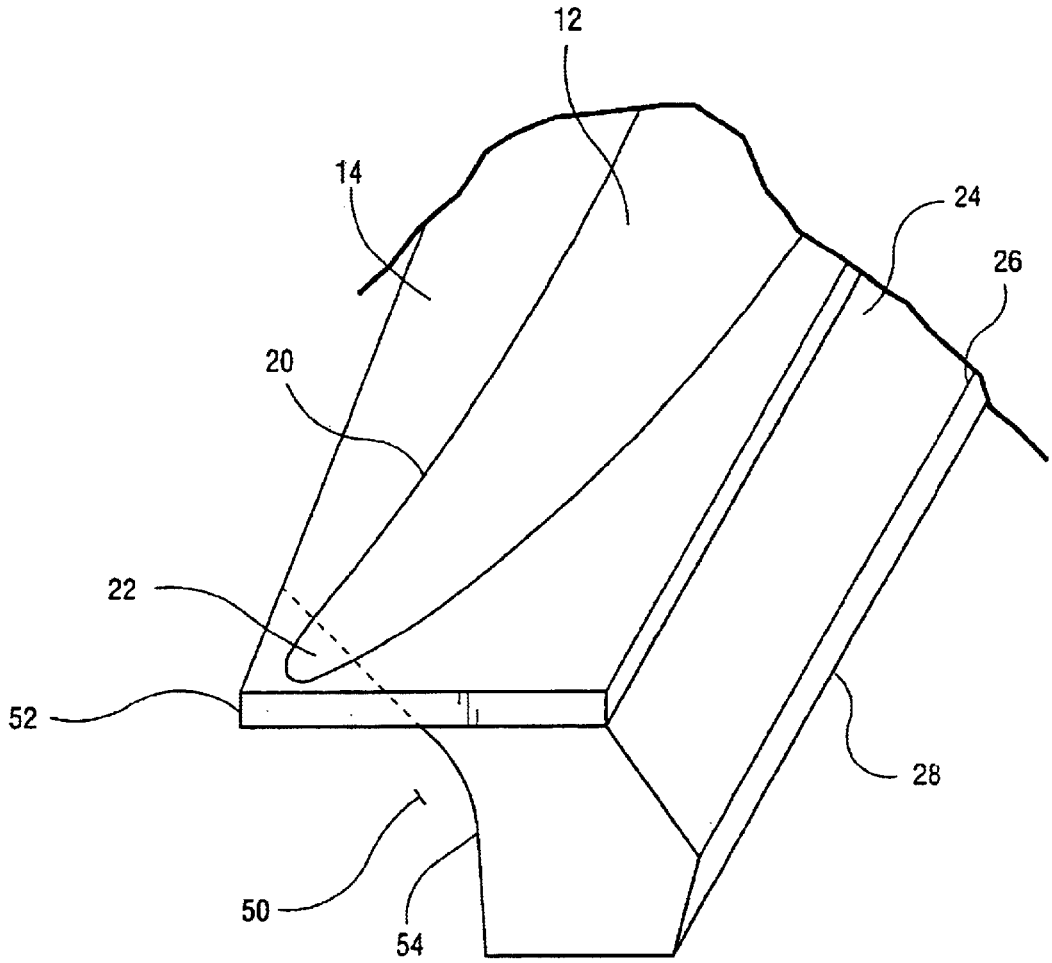
FIG. 3 is a cross-sectional view of another embodiment showing a portion of a dovetail having a removed corner.

In a further alternative embodiment shown in FIG. 3, a corner 50 of the dovetail neck 24 is removed from under the front corner 52 of the platform attached to the leading edge 22 of the airfoil shape. The cut-away section 54 unloads stresses from the leading edge 22 of the blade. Conventional dovetails are generally entirely rectangular in cross-section, and do not include a cut-away section, such as the slot 30 shown in FIGS. 1 and 2 or the removed corner 50 shown in FIG. 3. In FIG. 3, the cut-away section 54 is at a front corner of the dovetail and is below the leading edge 22 of the blade. The cut-away section 54 is also immediately adjacent the front corner 52 of the blade platform 14. The joint 56 between the cut-away section and the bottom of the platform includes a fillet with a generous radius to reduce the stress concentration at the joint.

The cut-away section 54 is removed to unload the front corner of the platform 14 and the blade leading edge 22 near the root 20. The cut-away portion 54 of the dovetail is machined to provide a smooth scalloped surface under the platform.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade of an axial compressor comprising:

an airfoil having a leading edge and a root;

a platform attached to the root of the airfoil;

a dovetail attached to a side of the platform opposite to the airfoil;

a neck of the dovetail adjacent the platform, and a slot in the neck and generally parallel to the platform, and said slot extending from a front of the neck to a position in the neck beyond a line formed by the leading edge of the blade.

2. A blade as in claim 1 wherein said slot extends a width of the neck.

3. A blade as in claim 1 wherein said slot is a key-hole shaped slot.

4. A blade as in claim 1 wherein said slot includes a narrow gap at a front of the slot and a cylindrical aperture at a rear of the slot.

5. A blade as in claim 1 wherein the slot has a narrow gap extending from the front of the neck and extending to a cylindrical aperture portion of the slot.

6. A blade as in claim 5 wherein said cylindrical aperture having an axis that is offset from said slot narrow gap.

7. A blade as in claim 1 further comprising an insert shaped to fit snugly in said slot.

8. A blade as in claim 5 further comprising an insert having a narrow rectangular section attached to a cylindrical section, and said insert fits in said slot.

9. A blade as in claim 1 wherein the blade is a first stage compressor blade.

10. A method for unloading centrifugal and vibratory stresses from a leading edge of an airfoil of a compressor blade having a platform and a dovetail, the method comprising:

a. generating a slot in the dovetail below a front portion of the platform, wherein the slot underlies the leading edge of the airfoil;

b. forming a cylindrical aperture at an end of the slot, wherein said cylindrical aperture is generally parallel to the platform and extends through the dovetail, and c. by generating the slot with the cylindrical aperture, reducing centrifugal and vibratory loads on at least the root of a leading edge of the blade.

11. A method as in claim 10 wherein the blade is a first stage compressor blade.

12. A method as in claim 10 wherein said slot extends a width of the neck.

13. A method as in claim 10 wherein said slot is generated as a key-hole shaped slot.

14. A method as in claim 10 wherein said slot is generated by cutting a narrow gap into a front of the neck and said cylindrical aperture formed at a rear of the narrow gap by drilling through the neck.

15. A method as in claim 10 wherein the slot is generated in casting the dovetail.

16. A method as in claim 10 further comprising sliding into said slot an insert which substantially fills the slot.

17. A blade of an axial compressor comprising:

an airfoil having a leading edge and a root;

a platform attached to the root of the airfoil;

a dovetail attached to a side of the platform opposite to the airfoil, and a neck of the dovetail adjacent the platform, wherein a corner of the neck aligned with the leading edge of the blade is not attached to a portion of the platform opposite to the leading edge of the blade and an opposite corner of the neck aligned with the leading edge of the blade is attached to the platform opposite to the leading edge of the blade and said neck further comprises a planer front surface between the corner and the opposite corner wherein said front surface is substantially parallel to a forward edge of the platform.

18. A blade as in claim 17 wherein the corner region of neck portion is a conical quarter section.

19. A blade as in claim 17 wherein the corner region is rounded.

20. A blade as in claim 17 wherein the corner region is joined to the platform via a fillet.

* * * * *

UNITED STATES PATENT AND TRADEMARK OFFICE

CERTIFICATE OF CORRECTION

PATENT NO. : 6,902,376 B2
DATED : June 7, 2005
INVENTOR(S) : James Gautreau et al.

It is certified that error appears in the above-identified patent and that said Letters Patent is hereby corrected as shown below:

Title page,
Item [75], Inventors, should include -- Chris Rickert, Greenville, S.C. (US) --.

Column 3,
Line 29, the phrase "...intersects with the narrow gap 31…" should read as -- ...intersects with the narrow gap 32… --.
Line 67, the phrase "...in the narrow section 33…" should read as -- in the narrow section 32… --.

Signed and Sealed this

Fourth Day of October, 2005

JON W. DUDAS
*Director of the United States Patent and Trademark Office*